US007445090B2

(12) United States Patent
Bodmer et al.

(10) Patent No.: US 7,445,090 B2
(45) Date of Patent: Nov. 4, 2008

(54) DEVICE AND METHOD FOR ELEVATOR INFORMATION DISPLAY

(75) Inventors: Christian Bodmer, Cham (CH); Steffen Grundmann, Bonstetten (CH); Lukas Finschi, Lucerne (CH); Kurt Steinmann, Rotkreuz (CH); Philipp Wyss, Root (CH)

(73) Assignee: Inventio AG, Hergiswil NW (CH)

( * ) Notice: Subject to any disclaimer, the term of this patent is extended or adjusted under 35 U.S.C. 154(b) by 553 days.

(21) Appl. No.: 11/156,000

(22) Filed: Jun. 17, 2005

(65) Prior Publication Data

US 2005/0279587 A1 Dec. 22, 2005

(30) Foreign Application Priority Data

Jun. 18, 2004 (EP) ..... 04405376

(51) Int. Cl.
*B66B 1/34* (2006.01)

(52) U.S. Cl. ..... 187/391; 187/396

(58) Field of Classification Search ..... 187/380–388, 187/391–396

See application file for complete search history.

(56) References Cited

U.S. PATENT DOCUMENTS 4,724,933 A 2/1988 Tsuji et al.
4,852,696 A * 8/1989 Fukuda et al. ..... 187/392
4,995,479 A * 2/1991 Fujiwara et al. ..... 187/397
5,042,620 A * 8/1991 Yoneda et al. ..... 187/382
5,551,533 A 9/1996 Ng
5,789,715 A * 8/1998 Kakko et al. ..... 187/397
7,036,635 B2 * 5/2006 Rintala et al. ..... 187/396
7,040,459 B2 * 5/2006 Matsuda et al. ..... 187/399

FOREIGN PATENT DOCUMENTS

| | | |
|---|---|---|
| CN | 1068561 C | 7/2001 |
| EP | 0 692 446 | 1/1996 |
| EP | 0 699 617 | 3/1996 |
| EP | 1 314 676 | 5/2003 |

* cited by examiner

*Primary Examiner*—Jonathan Salata
(74) *Attorney, Agent, or Firm*—Fraser Clemens Martin & Miller LLC; William J. Clemens

(57) ABSTRACT

A device and a method for informing passengers of an elevator installation in a building includes at least one information display at at least one start floor and/or at least one second information display in at least one car. The first information display indicates the arrival time of a car at a start or destination floor and the second information display indicates the arrival time of the car at a destination floor.

12 Claims, 4 Drawing Sheets

DEVICE AND METHOD FOR ELEVATOR INFORMATION DISPLAY

BACKGROUND OF THE INVENTION

The present invention relates to a device and a method for informing passengers of waiting times in an elevator installation.

U.S. Pat. No. 5,551,533 discloses an elevator installation with several elevators in a building and with a plurality of loudspeakers mounted at floors of the building and in cars of the installation. Passengers waiting at the start floor are informed by way of these loudspeakers by announcements about a car to be used for reaching a destination floor, the anticipated arrival time and the occupancy of these cars as well as generally about the operational state of the elevator installation.

According to this teaching in the case of peak times, with a large number of passengers in front of the entrances to the elevators, a correspondingly large number of loudspeaker announcements are made which leads to background noise taxing the waiting passengers. In addition, the passengers have to constantly and closely concentrate in order to hear the announcements intended for them, which is wearisome and confusing. A more pleasant and less hectic means of informing the passengers is desirable.

It is further desirable to inform the passengers not just once about the cars to be used and their expected arrival time, but to keep them up-to-date individually and either continuously or at intervals in time about the development of the traffic volume. This contributes to reassurance of the passengers particularly in the case of unexpected delays in the handling of traffic.

SUMMARY OF THE INVENTION

The present invention has the object of providing a device and a method for informing passengers of an elevator installation in a building in which the passengers are informed, even at peak times, in a pleasant mode and manner individually and either continuously or at intervals in time.

This object is fulfilled by the present invention concerning a device and a method for informing passengers. For a building with at least one start floor and destination floor and an elevator installation with at least one car, the arrival time of the car at the start floor or destination floor is indicated by way of at least one first information display and/or the arrival time of the car at the destination floor is indicated by way of at least one second information display.

The passengers are thus kept up-to-date individually and continuously by way of the displays at the floor and in the car about the development of the traffic volume without creation of a burdensome background noise. During travel in the building the passengers can initially concentrate on a first information display at the start floor and later on a second information display in the car and be aware in simple, convenient and reliable manner of changes in the displayed information.

Advantageously, each passenger actuates a call at a panel at the start floor or in the car. This call can be a floor call, a car call or a destination call. After actuation of a call an estimated arrival time is initially indicated to the passenger by way of the first or second information display and thereafter an actual arrival time is indicated to the passenger by way of the first or second information display.

Advantageously a planning control determines the estimated arrival time, whilst an elevator installation control determines the actual arrival time. In this manner an estimated arrival time is made available to the passenger immediately after actuation of the call as an answer and acknowledgement of the call. As soon as an actual arrival time is available, this actual arrival time is indicated on the first or second information display in place of the estimated arrival time.

Advantageously, discrepancies between the estimated arrival time and the actual arrival time are balanced out and made imperceptible on the first or second information display to the passengers in that an arrival time sequence is indicated which converges towards the actual arrival time.

Advantageously, apart from the arrival time of the car at the start floor or destination floor an arrival time at least one next stop of the car is also indicated on the first or second information display.

Advantageously the first or second information display comprises a device for identification or authentication of the passengers. The safety of the passengers during travel in the building is increased in this manner.

Advantageously an arrival time linked with at least one further item of information is indicated. Thus, apart from the arrival time there is also indicated the floor to which the arrival time relates. In addition, an arrival time at a floor is indicated together with the designation of the car by which the passenger is moved to the destination floor. There is also indicated to the passenger the direction the passenger has to take in order to go from the first information display to the car. Alternatively, there is indicated an arrival time at a destination floor together with an indication of the destination of the passenger at the destination floor, or the name of an identified passenger is indicated together with his or her arrival time. Through communication of at least one such further item of information together with the arrival time there is enhancement of the passenger information, which offers to the passengers an even greater overview and travel convenience.

Advantageously the first or second information display is integrated in the panel by way of which the passenger actuates his or her call. Advantageously the first and the second information display is an individual apparatus which can be mounted adjacent to existing standard panels without an information display.

Advantageously the first or second information display is a digital numerical display and/or digital bar row or an analog light row. The time remaining until arrival is indicated in readily readable numerals and/or by the length of a flashing bar row or the length of an illuminated light row. In this manner the passenger recognizes at a glance and continuously how long it is necessary to wait until arrival.

Advantageously the arrival time is indicated to the passenger only during a specific period of time or the arrival time is indicated to the passenger only at specific instants. Particularly at peak times where many calls are initiated the individual passengers are in this manner not overloaded with information, but are nevertheless individually informed selectively in terms of time. Thus, the indication of an arrival time takes place only during a specific time period after input of a call. Thereafter it extinguishes. The display of an arrival time can be repeated at regular or irregular time segments. Alternatively, the indication of an arrival time takes place only after fulfillment of a further condition such as actuation of a specific activation button or the identification or authentication of the passenger.

DESCRIPTION OF THE DRAWINGS

The above, as well as other advantages of the present invention, will become readily apparent to those skilled in the art from the following detailed description of a preferred embodiment when considered in the light of the accompanying drawings in which.

DESCRIPTION OF THE PREFERRED EMBODIMENT

Figure 1:
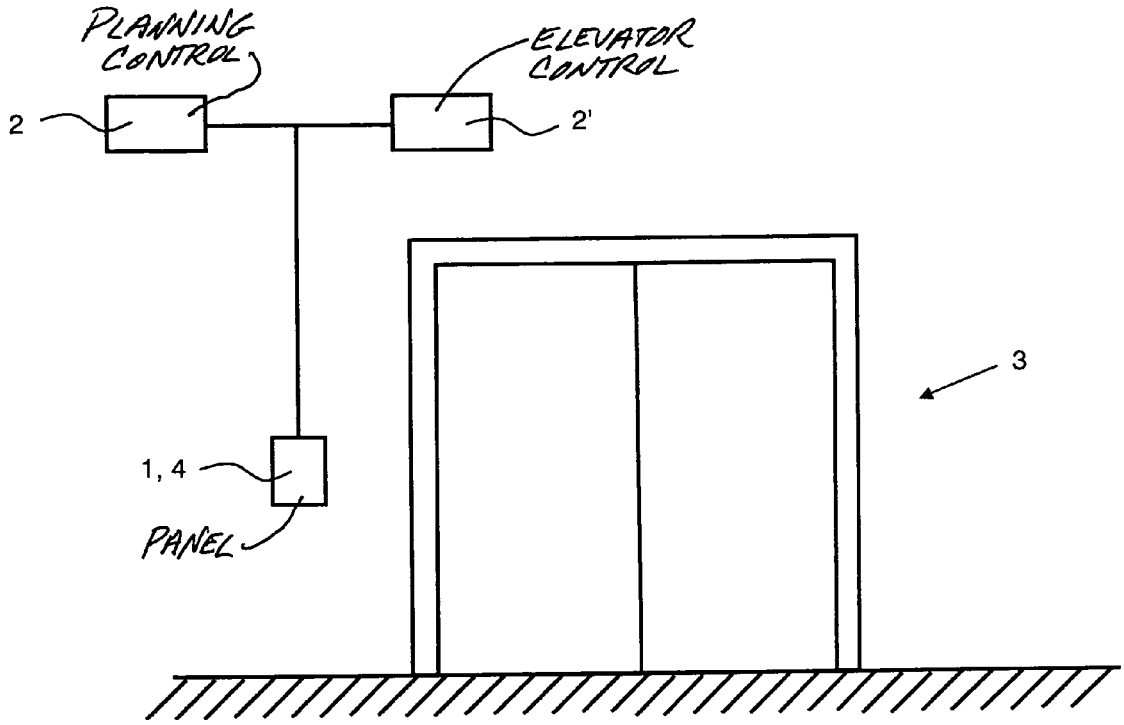
FIG. 1 is a schematic view of a device for informing passengers, with a first information display according to the present invention at an elevator start floor.
Figure 2:
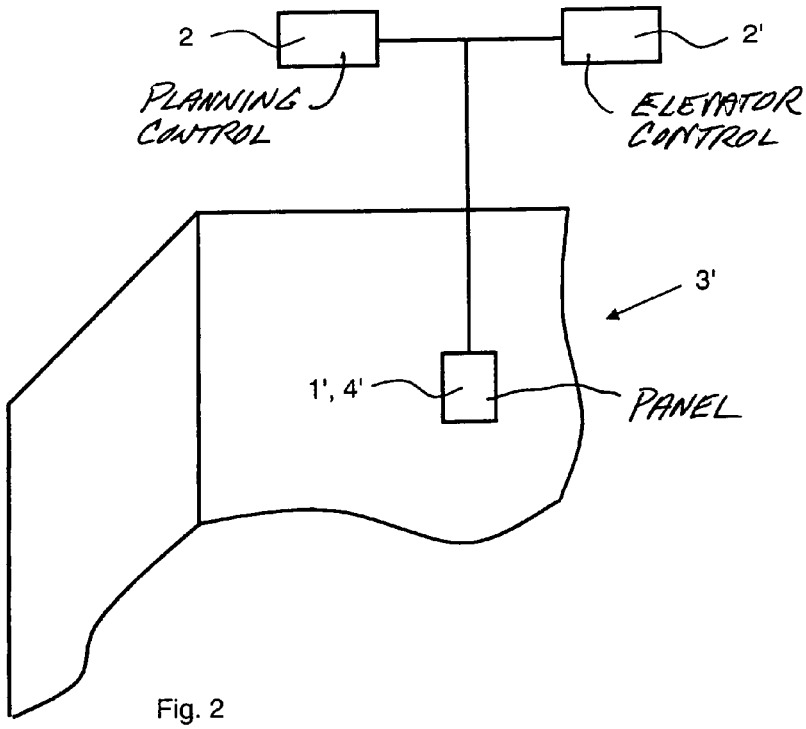
FIG. 2 is a schematic view of a device for informing passengers, with a second information display according to the present invention in an elevator car.

FIGS. 1 and 2 show different schematic partial views of a building with an elevator installation. The building can be any desired building which has at least one start floor 3 and at least one destination floor, between which passengers are moved by the elevator installation in at least one car 3'. In order to travel, the passengers actuate calls by way of at least one panel 4, 4'. The panel 4, 4' is either a floor panel 4 with a device for informing passengers with a first information display 1 mounted near the floor doors of the elevator installation or also as a car panel 4' with a device with a second information display 1' mounted in the car 3'. The calls can be, for example, floor calls, car calls or destination calls. In the case of a floor call a car is called from a floor panel to the start floor at which the floor panel is arranged. In the case of a car call a car is called from a car panel to a destination floor. In the case of a destination call a car is called from a floor panel to the start floor at which the floor panel is arranged and the passenger boarding the car is thereupon moved to the destination floor without actuation of a car call from the car.

Figure 3:
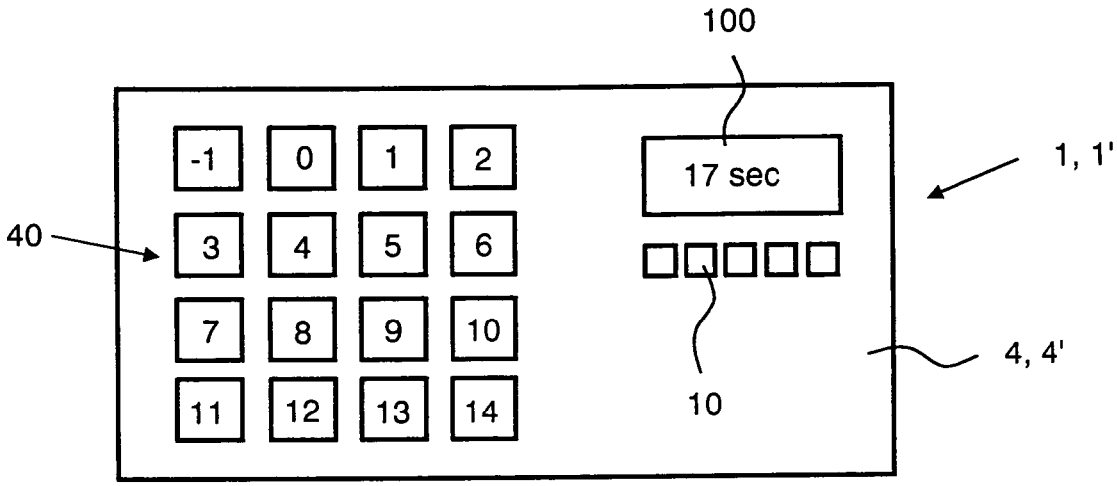
FIG. 3 is an elevation view of the first embodiment of the device for informing passengers shown in FIG. 1, with an arrival display in the form of a digital numerical indication and a digital bar row as a component of the panel.

FIG. 3 shows a first embodiment of a device for informing passengers, as a component of the panel 4, 4', which is constructed as a freely programmable flat screen. The flat screen can be a commercially available touch-screen. Freely programmable means that the surface of the flat screen can be formed as desired in accordance with the respective operating mode, kind of elevator installation, number of floors in the building, traffic volume, etc. Individual regions of the surface of the flat screen are programmed as a call input 40, for example with key fields "−1" to "14", which key field designations correspond with floors of the building to which the car 3' can travel. Other regions are programmed as first and second information displays 1, 1' with a digital numeral display 100 and a digital bar row 10.

Figure 4:
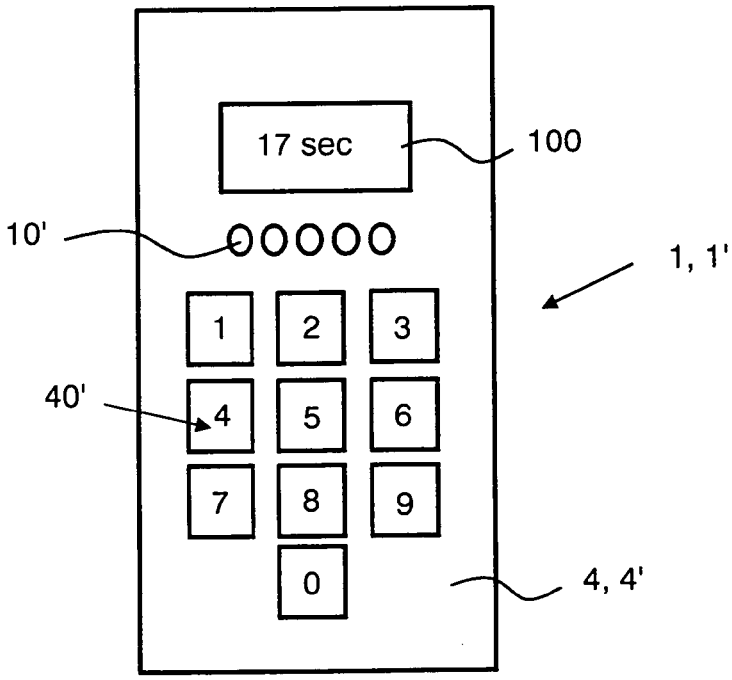
FIG. 4 is an elevation view of the second form device for informing passengers shown in FIG. 2, with an arrival display in the form of a digital numerical display and analog light row as a component of a panel.

FIG. 4 shows a second embodiment of a device for informing passengers as a component of the panel 4, 4' with mechanical buttons. The panel 4, 4' uses, as call input 40, a known decade keyboard, in which the mechanical buttons are marked with "0" to "9" and serve for actuation of calls. The panel 4, 4' moreover comprises first and second information displays 1, 1' with the digital numerical display 100 and an analog light row 10'. The analog light row 10' can consist of a row of light-emitting lights (LEDs). With knowledge of the present invention it is freely available to the expert to realize numerous variations and combinations for this purpose. Thus, instead of a panel with a decade keyboard other button panels, for example such with dedicated buttons for each floor to which the car 3' can travel, can also be used. The combined use, which is illustrated in FIGS. 3 and 4, of the bar row 10 or the light row 10' in conjunction with the digital numerical indicator 100 is not absolutely necessary; it is entirely possible to provide only the bar row 10 or only the light row 10' or only the digital numeral display 100. In addition, it is not obligatory to integrate the first and second information displays 1, 1' in the panel 4, 4'; thus, the first and second information displays 1, 1' can also be mounted as an individual apparatus, for example adjacent to standard panels without information displays, as the further forms of embodiment of a device for informing passengers according to FIGS. 5 to 9 show.

The digital numerical display 100, the digital bar display 10 and the analog light row 10' are arrival displays which indicate the arrival time as a continuously decreasing time display. In the forms of embodiment according to FIGS. 3 to 9 the arrival display in the form of a digital numerical display 100, 100' indicates the arrival time as a difference from the current clock time in a second revolution of "17 sec" or "10 sec" or "2 sec", which difference decreases in regular steps of seconds towards zero. Correspondingly, the digital bar display 10 or the analog light row 10' indicates the arrival time as a difference relative to the current clock time as a bar length or light row length regularly decreasing towards zero. Numerous possibilities of variation are available to the expert with knowledge of the present invention. Thus, instead of a light row there can also be used a single light which illuminates in different colors and which reproduces the decrease in the difference between current clock time and arrival time by way of color change. It is also possible for this purpose to provide lights flashing with different rapidity.

The arrival time of a passenger can be displayed to the passenger at the first or second information display 1, 1' only during a specific period of time or only at specific points in time. For example, the arrival time is effected at the digital numerical indicator 100, 100' only during a specific time period of 2 to 5 seconds after input of a call and thereafter extinguishes. It is also possible to repeat the display of the arrival time at regular or irregular times of, for example, every 60 seconds.

In the basic embodiment the first information display 1 indicates the arrival time of the car 3' at a start floor 3, whilst the second information display 1' indicates the arrival time of a car 3' at a destination floor. In further embodiments of a device for informing passengers according to FIGS. 5 to 9 the arrival time is indicated, at the first or second information display 1, 1', linked with at least one further item of information.

Figure 5:
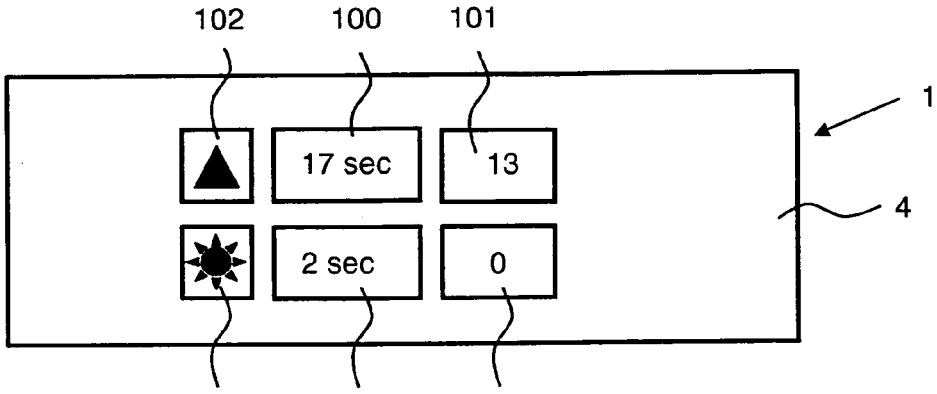
FIG. 5 is an elevation view of a third embodiment of a device for informing passengers according to the present invention, with arrival displays for indication of the arrival time at start floor and destination floor.

As shown in the third embodiment of a device according to FIG. 5 for informing passengers, the arrival time of the car 3' at the destination floor can be indicated at the first information display 1 on the first digital numerical display 100 and at the same time the arrival time of the car 3' at the start floor 3 can be indicated on the further digital numerical display 100'. The further digital numerical display 100' is arranged in a further row below the first digital numerical display 100. A stop display 102, 102' is arranged in front of each of the digital numerical displays 100, 100'. The first stop display 102 indicates the destination stop of the car 3' to which the passenger will travel. The further stop display 102' indicates the start-off stop of the car 3' from where the passenger will travel. Arranged behind each of the digital numerical displays 100, 100' is a floor display 101 or 101' which indicates the destination floor "13" or the start floor "0". With knowledge of the present invention the expert can obviously also use, instead of such a further digital numerical display 100', a further digital bar display or a further analog light display. In addition, more than two rows of such displays can be used.

Figure 6:
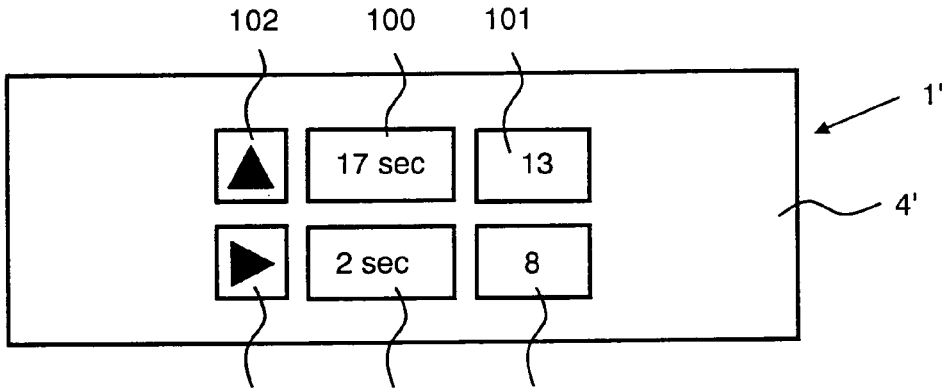
FIG. 6 is an elevation view of a fourth embodiment of a device for informing passengers according to the present invention, with arrival displays for indication of the arrival time at the next stop and at the destination floor.

The fourth embodiment of a device for informing passengers according to FIG. 6 indicates at the second information display 1' on the first digital numerical display 100 not only the arrival time of the car 3' at the destination floor, but simultaneously therewith by way of the further digital numerical display 100' also the arrival time of the car 3' at least one next stop during the travel of the car 3'. The further digital numerical display 100' is arranged in a further row below the first digital numerical display 100. A stop display 102, 102' is arranged in front of each of the digital numerical displays 100, 100'. A first stop display 102 indicates the destination of the car 3' to which the passenger will travel. A further stop display 102' indicates the next stop of the car 3'. Arranged behind each of the digital numerical displays 100, 100' is a floor display 101 or 101' which indicates the destination floor "13" or the floor "8" corresponding with the next stop. With knowledge of the present invention an expert can also integrate a display of the arrival time of the car 3' at a next stop in a first information display 1 at the start floor 3. In addition, the expert can also use, instead of a further digital numerical display 100', a further digital bar display or a further analog light row as well as more than two rows of such displays. Finally, not only the next car stop, but also the next-but-one stop and further stops of the car 3' can be indicated on the information display 1'.

Figure 7:
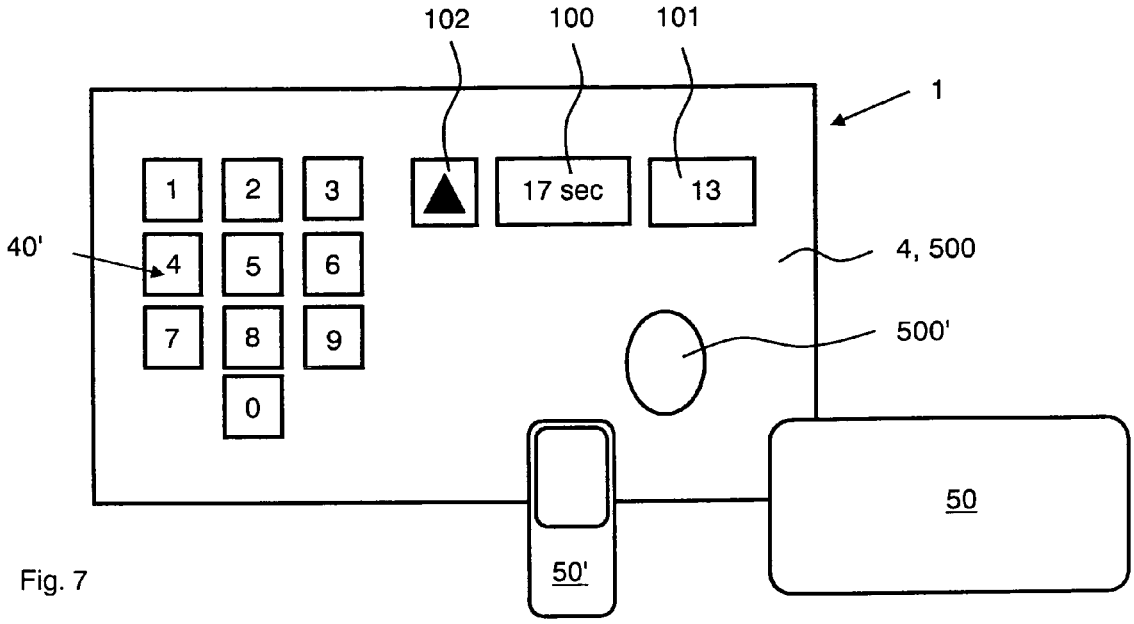
FIG. 7 is an elevation view of a fifth embodiment of a device for informing passengers according to the present invention, with an arrival display and a device for identification or authentication of the passenger.

The fifth embodiment of a device according to FIG. 7 for informing passengers shows the first information display 1 with a device for identification or authentication of a passenger. Such a device, where the passenger is identified by way of an identification code, is disclosed in the European patent specification EP 0 699 617 A1. An identification code is recognized at the device after input by way of the keyboard 40, 40' and/or after radio transmission of a transponder 50 carried by the passenger to a reading apparatus 500 arranged in the first information display 1. It is thereupon checked whether an access authorization to a destination floor exists for the identification code or whether a predefined destination floor exists. Only after successful checking of the identification code is the passenger moved by the elevator installation to the destination floor. A device where, in addition to recognition of an identification code, an authentication of the passenger by way of, an authentication signal also takes place is disclosed in the European patent specification EP 1 314 676 A1. In that case a biometric signal is detected from the passenger by means of a biometric sensor 500' arranged on the first information display 1 and checked with a filed reference. For example, a fingerprint of a finger 50' of the passenger is detected. In the case of correspondence of authentication signal and reference as well as in the case of successful checking of the identification code the passenger will travel by the elevator installation to the destination floor. A first stop display 102 indicates the destination of the car 3' to which the passenger will travel. The stop display 102 indicates the destination of the car 3'. A digital numerical display 100 indicates the time "17 sec" which remains until arrival at the destination floor. The floor display 101 indicates the destination floor "13". With knowledge of the present invention an expert can also integrate such a device for identification or authentication of a passenger in a second information display 1' of a car 3'.

Figure 8:
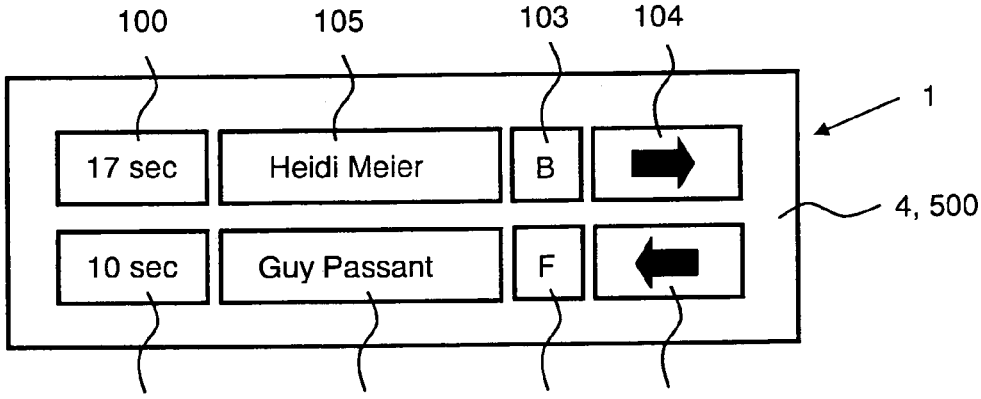
FIG. 8 is an elevation view of a sixth embodiment of a device for informing passengers according to the present invention, with several arrival displays for simultaneous, individual informing of several passengers by indication of the elevator to be used.

In the sixth embodiment of a device according to FIG. 8 for informing passengers the first information display 1 indicates to two passengers, simultaneously on digital numerical displays 100, 100' arranged one above the other in two rows, the arrival times "17 sec" and "10 sec". The name of the passenger, identified beforehand, is displayed behind each of the digital numerical displays 100, 100'. Arranged behind a first digital numerical display 100 is a first name display 105, which indicates the name "Heidi Meier" of the first identified passenger. Correspondingly, arranged behind a second digital numerical display 100' is a second name display 105' which indicates the name "Guy Passant" of the second identified passenger. The two passengers are identified by means of, for example, the reading apparatus 500 which recognizes an identification code of a transponder carried by the passengers. Arranged behind the first name display 105 is a first car display 103 indicating the car "B" at which the first passenger will travel to his or her destination. Correspondingly, arranged behind the second name display 105' is a second car display 103' indicating the car "F" at which the second passenger will travel to his or her destination. Moreover, arranged behind the first car display 103 is a first car direction display 104 indicating an arrow which is directed to the right and which shows to the first passenger the direction from the first information display 1 to the car "B". Correspondingly, arranged behind the second car display 103' is a second car direction display 104' indicating an arrow which is directed to the left and which shows to the second passenger the direction from the first information display 1 to the car "F".

Figure 9:
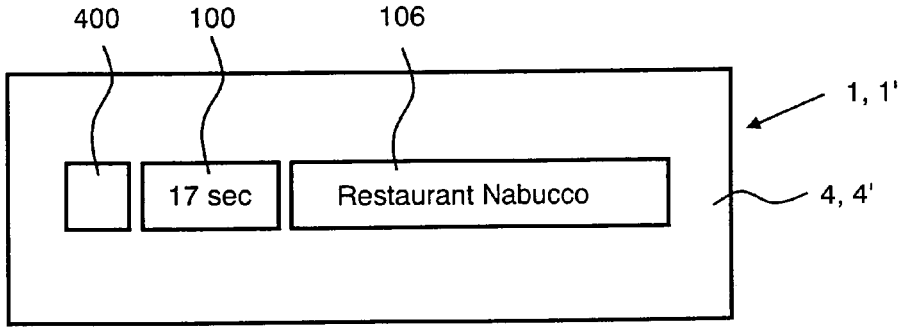
FIG. 9 is an elevation view of a seventh embodiment of the device for informing passengers according to the present invention, with an activation button of the arrival display and destination display.

The seventh embodiment of a device according to FIG. 9 for informing passengers indicates at a first or second information display 1, 1' on a digital numerical display 100 the remaining time "17 sec" until arrival of the passenger at the destination floor. The destination "Restaurant Nabucco" of the passenger at the destination floor to which the passenger will travel is denoted on a destination display 106 arranged behind the digital numerical display 100. Such destination information is, for example, stored in a memory and able to be called up by the elevator installation control. The passenger can activate the arrival display by actuation of an activation button 400, which is arranged in front of the digital numerical display 100, of the first or second information display 1, 1'.

With knowledge of the present invention there are available to the expert numerous possibilities of variation and combination of the forms of embodiment of first and second information displays 1, 1', which for reasons of space are not explained in more detail.

As shown in FIGS. 1 and 2, a planning control 2 and an elevator installation control 2' are connected to the panels 4, 4' with-the first information display 1 mounted at the floor 3 and the second information display 1' mounted in the car 3'. The planning control 2 determines an estimated arrival time, whilst the elevator installation control 2' determines an actual arrival time.

The planning control can be a known computer-implemented method in which different performance characteristics of an elevator installation are measured in a test operation or are ascertained by means of simulation or other calculation methods, such as the number of passengers served in a specific time segment and/or per passenger the time which the passenger needs in order to go by means of the elevator installation from his or her start floor to a desired destination floor (destination time) or the time between the call actuated by him or her or his or her arrival at the elevator installation until arrival of the car serving him or her (waiting time) at the start floor, the number of halts (stops) during travel from start floor to destination floor, as well as statistically derived values (for example, mean values) of travel times between floors as well as of door opening and door closing times and residence times of the cars at floors. Arrival times of the cars at start floors or arrival times of the individual passengers at destination floors are estimated from the sum of such times, which lie in the second or minute range per journey.

The elevator installation control is a known control which operates not with estimated performance characteristics, but with real, actual performance characteristics of the elevator installation. Since such an actual arrival time is a function of many, constantly changing actual performance characteristics, this can be determined at the instant of actuation of a call only with a low probability. However, the accuracy of the actual arrival time increases with the working down of the call by the elevator installation control. Thus, for example, on actuation of the call it cannot be precisely predicted how many stops a car assigned to the call will actually make until it reaches the start floor. If, however, at this early point in time in the working down of the call the actual arrival time at the start floor cannot be accurately ascertained, then this applies even less for the actual arrival time at the destination floor. On the other hand, at a later point in time in the working down of the call, for example when the passenger is already located in the car for the destination floor, the actual arrival time at the destination floor is available with high probability.

For this reason, after actuation of a call initially an estimated arrival time is displayed to the passenger by way of the first or second information display 1, 1' and only thereafter is an actual arrival time displayed to the passenger by way of the first or second information display 1, 1'. The passenger thus has available immediately after actuation of the call an estimated arrival time as response and confirmation of the call by the planning control. As soon as an actual and highly probable arrival time is available, this actual arrival time is indicated on the first or second information display 1, 1' in place of the estimated arrival time. For example, an actual arrival time is indicated in place of the estimated arrival time as soon as the discrepancy is less than 10%. An actual arrival time is, with such a small discrepancy, regarded as highly probable.

So that such discrepancies are indicated on the first or second information display in a manner not noticeable for the passengers, on occurrence of a discrepancy there is indicated, instead of an actual arrival time, an arrival time sequence which converges towards the actual arrival time. In the case of a negative discrepancy the difference between the current clock time and the estimated arrival time is greater than the difference between the current clock time and the actual arrival time. In the case of a positive discrepancy the difference between the current clock time and the estimated arrival time is less than the difference between the current clock time and the actual arrival time. In this manner on switching over from the estimated arrival time to the actual arrival time there is avoidance of disturbance of the apparent image of a continuously decreasing time indication on the digital numerical display 100 or the digital bar display 10 or the analog light row 10' of the first or second information display 1, 1' and of confusion of the passengers.

Such arrival time sequences can be realized in several forms.

Thus, the decrease in the difference between current clock time and arrival time is accelerated or slowed down, in a manner not noticeable for the passengers, in order to thus compensate for a negative discrepancy or positive discrepancy.

If in the case of an elevator installation more negative than positive discrepancies arise, compensation can be provided for this asymmetry by indication of an optimistically estimated arrival time, which, for example, lies 5% below a realistic estimated arrival time. In analogous manner on occurrence of more positive than negative discrepancies a conservatively estimated arrival time is indicated which, for example, now lies 5% above a realistic estimated arrival time. System-induced discrepancies can be eliminated in this manner.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. A device for informing passengers of an elevator installation in a building comprising:

at least one of a first information display at a floor of the building and a second information display in a car of the elevator installation; and control means for operating said first information display to display an arrival time of a car at the floor and for operating said second information display to display an arrival time of the car at a destination floor.

2. The device according to claim 1 wherein in response to actuation of a call said at least one of said first and second information displays initially displays an estimated arrival time and thereafter displays an actual arrival time.

3. The device according to claim 2 wherein said control means includes a planning control that determines the estimated arrival time and an elevator installation control that determines the actual arrival time.

4. The device according to claim 2 wherein said at least one of said first and second information displays, in case of a discrepancy between the displayed estimated arrival time and the actual arrival time, displays an arrival time sequence which converges towards the actual arrival time.

5. The device according to claim 1 wherein said at least one of said first and second information displays displays the arrival time of the car as at least one of an arrival time at a next stop, only during a specific time period, to a passenger repeatedly and of several passengers in alternation.

6. The device according to claim 1 wherein said at least one of said first and second information displays displays the arrival time linked with at least one of a floor display, a car display, a car direction display and a destination display.

7. The device according to claim 1 wherein said at least one of said first and second information displays displays the arrival time only after at least one of successful checking of an identification code, correspondence of an authentication signal with a reference and actuation of an activating button.

8. The device according to claim 1 wherein said at least one of said first and second information displays is one of a digital numerical display, a digital bar display and an analog light row.

9. The device according to claim 1 wherein said at least one of said first and second information displays is integrated in a panel of the elevator installation.

10. A method of informing passengers of an elevator installation in a building comprising the steps of:

providing an information display;

positioning the information display at one of a floor of the building and an elevator car of the elevator installation;

operating the information display to display an arrival time of a car, the arrival time representing an arrival time at the floor when the information display is positioned at the floor and an arrival time of the car at a destination floor when the information display is positioned in the car.

11. The method according to claim 9 wherein after actuation of a call operating the information display to initially display an estimated arrival time and thereafter operating the information display to display an actual arrival time.

12. A device for informing passengers of an elevator installation in a building comprising:

a plurality of first information displays each being positioned at an associated floor of the building;

a plurality of second information displays each positioned in an associated car of the elevator installation; and control means for operating each of said first information displays to display an arrival time of a car at the associated floor and for operating each of said second information displays to display an arrival time of the associated car at a destination floor.

* * * * *